United States Patent [19]

Sansevero et al.

[11] Patent Number: 5,050,721

[45] Date of Patent: Sep. 24, 1991

[54] STEP RISER PROFILE FOR CURVED ESCALATOR

[75] Inventors: Frank Sansevero, West Hartford, Conn.; Peter Borchers, Bad Nenndorf/OT Hackmuhlen; Knut Wallbaum, Wunstorf, both of Fed. Rep. of Germany

[73] Assignee: Otis Elevator Company, Farmington, Conn.

[21] Appl. No.: 580,742

[22] Filed: Sep. 11, 1990

[51] Int. Cl.[5] ..... B66B 21/00; B66B 23/12

[52] U.S. Cl. ..... 198/328; 198/333

[58] Field of Search ..... 198/326, 327, 328, 333, 198/778

[56] References Cited

U.S. PATENT DOCUMENTS

| | | | |
|---|---|---|---|
| 617,778 | 1/1899 | Seeberger . | |
| 617,779 | 1/1899 | Seeberger . | |
| 685,019 | 10/1901 | Venn . | |
| 723,325 | 3/1903 | Souder . | |
| 782,009 | 2/1905 | Dodge . | |
| 967,710 | 8/1910 | Bennett . | |
| 984,495 | 2/1911 | Seeberger . | |
| 984,858 | 2/1911 | Seeberger . | |
| 999,885 | 8/1911 | Seeberger . | |
| 2,695,094 | 11/1954 | Riley . | |
| 2,823,785 | 2/1958 | Hefti . | |
| 3,878,931 | 4/1975 | Luna | 198/16 |
| 4,662,502 | 5/1987 | Nakatani | 198/328 |
| 4,726,460 | 2/1988 | Otomo | 198/328 |
| 4,730,717 | 3/1988 | Sugita | 198/328 |
| 4,739,870 | 4/1988 | Saito | 198/328 |
| 4,746,000 | 5/1988 | Nakatani et al. | 198/328 |
| 4,775,043 | 10/1988 | Tomidokoro | 198/328 |
| 4,883,160 | 11/1989 | Sansevero et al. | 198/328 |
| 4,884,673 | 12/1989 | Rivera | 198/328 |
| 4,895,239 | 1/1990 | Johnson et al. | 198/328 |

FOREIGN PATENT DOCUMENTS

| | | |
|---|---|---|
| 3441845 | 6/1985 | Fed. Rep. of Germany . |
| 48-25559 | 7/1973 | Japan . |
| 58-220077 | 12/1983 | Japan . |
| 292641 | 6/1928 | United Kingdom . |

*Primary Examiner*—Joseph E. Valenza
*Assistant Examiner*—Tuan N. Nguyen
*Attorney, Agent, or Firm*—William W. Jones

[57] ABSTRACT

An escalator which follows a curvilinear path with a fixed center constant radius in plan must have steps with specially configured risers. The step risers will have vertical cleats which mesh with trailing edges of adjacent steps, which meshing must be performed without risk of jamming. The escalator has an outer step chain which changes its effectual length over the path of travel of the escalator, whereby it is shorter in the inclined zone and longer in the landing zones of the escalator. The radii of the step risers, in elevation must thus decrease along the step riser cleats as the cleats descend away from the step tread.

5 Claims, 2 Drawing Sheets

STEP RISER PROFILE FOR CURVED ESCALATOR

DESCRIPTION

1. Technical Field

This invention relates to curved escalators, and more particularly, to the step riser profile for a step used in a curved escalator which follows an arcuate path defined by a fixed center and constant radius.

2. Background Art

Escalators which follow a curved path of travel from entry landing to exit landing are generally known in the prior art. There are two general approaches which have been taken in the prior art to designing an operable curved escalator. One approach involves the use of a path of travel which, in plan, is defined by an arc having varying radii of curvature and emanating from a shifting center. The other approach involves the use of a path of travel which, in plan, is defined by an arc of constant radius struck from a fixed center.

Patent publications which relate to the aforesaid first approach include: Japanese Patent Publication 48-25559 of July, 1973; German Patent Publication 3,441,845, June 13, 1985; U.S. Pat. No. 4,662,502, Nakatani et al, granted May 5, 1987; and U.S. Pat. No. 4,746,000, Nakatani et al, granted May 24, 1988.

Patent publications which relate to the aforesaid second approach include: U.S. Pat. Nos. 685,019, Oct. 22, 1901; U.S. Pat. No. 723,325, Mar. 24, 12, 1903; U.S. Pat. No. 782,009, Feb. 7, 1905; U.S. Pat. No. 967,710, Aug. 16, 1910; U.S. Pat. No. 2,695,094, Nov. 23, 1954; U.S. Pat. No. 2,823,785, Feb. 18, 1958; U.S. Pat. No. 3,878,931, Apr. 22, 1975; U.S. Pat. No. 4,726,460, Feb. 23, 1988; U.S. Pat. No. 4,730,717, Mar. 15, 1988; U.S. Pat. No. 4,739,870, Apr. 26, 1988; British Patent No. 292,641, June 22, 1928; and Japanese Patent Disclosure No. 58-220077, 1983.

Japanese Patent Disclosure No. 58-220077, dated Dec. 21, 1983 discloses a curved escalator which has a constant radius, fixed center arcuate path of travel when viewed in plan. When the treads of the escalator move from the horizontal landing to the constant slope intermediate zone, they are properly repositioned by accelerating and decelerating their inside edges in the transition zones adjacent the landings. The differential movement of the inside tread edges is accomplished with pivoting links which interconnect the step axles of adjacent steps and which are joined at pivot points provided with rollers that traverse a track. The step axles also have rollers at their inside ends which travel over another track vertically spaced from the link roller track. The position of the inside edges of the steps is varied in the transition zone by varying the vertical distance between the inside step axle roller track and the link roller track beneath it. The links lengthen in the constant slope portion of the escalator and shorten in the horizontal landing and turn around zones. The steps are engaged by driving chains which connect to the step axles only in the constant slope zone where the position of the steps relative to each other remains constant. The drive chains do not contact the step axles in the transition landing, or turn around zones. Varying the position of the inside edge of the steps requires that the connecting links be shortened in the horizontal and turn around zones of the escalator, and the use of two separate tracks for the inside step axle roller and for the adjustment link rollers, requires that the adjustment links will always be skew throughout the entire path of travel of the escalator. The use of two separate axle roller and link roller tracks also requires that the drive housing and tread reverse sprockets be vertically elongated. Charles D. Seeberger was a turn-of-the century inventor who obtained U.S. Pat. No. 617,778, granted Jan. 17, 1899; U.S. Pat. No. 617,779, granted Jan. 17, 1899; U.S. Pat. No. 984,495, granted Feb. 14, 1911; U.S. Pat. No. 984,858, granted Feb. 21, 1911; and U.S. Pat. No. 999,885, granted Aug. 8, 1911, which all relate to curved escalators. The U.S. Pat. No. 617,779 patent discusses the need to shorten and lengthen step chains in a curved escalator having a path of travel which has portions with different radii. The step chains are formed with segments which are threadedly connected to each other. The segments are rotated by a pinion mechanism to unscrew, or tighten the threaded connections whereby the chain is lengthened or shortened when necessary. The U.S. Pat. No. 984,495 patent states that a curved escalator with a fixed radius, constant center cannot have both ends of adjacent step axles connected to each other by links of fixed length. A scissor connection is then made between succeeding axles, and a slight adjustment of this connection is made when the steps move from the curved horizontal track section to the inclined curved section of the track. The adjustment is described at Page 3, line 119 to Page 4, line 28 of the patent. The U.S. Pat. No. 999,885 patent describes a curved escalator having its steps connected together at their inner and outer edges, with the outer edge connection being of constant length, and the inner edge connection being variable by reason of adjustable links.

U.S. Pat. No. 4,883,160, granted Nov. 28, 1989 to F. M. Sansevero, et al; U.S. Pat. No. 4,884,673, granted Dec. 5, 1989 to J. A. Rivera; and U.S. Pat. No. 4,895,239, granted Jan. 23, 1990 to G. E. Johnson, all of which are assigned to Otis Elevator Company, disclose curved escalators which follow a constant radius path of travel in plan, and which utilize an outer step chain which is shortened in the inclined portions of the path of travel, and lengthened in the horizontal portions of the path of travel. These disclosures thus relate to an escalator utilizing the second general approach described first above.

It will be appreciated that when the escalator uses steps having tread and riser cleats which intermesh, care must be taken to prevent jamming of the cleats as the steps move up and down in the escalator transition zones. Due to the curved path of travel of the escalator, conventional linear escalator step risers cannot be used in a curved escalator.

U.S. Pat. No. 4,775,043 granted Oct. 4, 1988 to M. Tomidokoro discloses a step for a curved escalator which follows a path defined by a varying radius taken from shifting center points, i.e., for an escalator which utilizes the first approach described first above. It will be readily apparent that the step described in the U.S. Pat. No. 4,775,043 patent is uniquely suited for a "first approach" curved escalator, and cannot be used, as described, in a "second approach" curved escalator.

DISCLOSURE OF THE INVENTION

This invention relates to an escalator step which has intermeshing tread/riser cleats, and which is particularly designed to traverse a curved path which has a constant radius in plan struck from a fixed center. The escalator has a radially inner step chain which has a fixed length, and a radially outer step chain which is shortened in the inclined portions of the path of travel and lengthened in the horizontal portions of the path of travel. This step chain action causes the step to be twisted or pivoted by the chains. The step of this invention has a particularly configured riser which allows the steps to remain intermeshed as they are twisted one way, and then the other way in the transition zones of the escalator. In order to accommodate the shifting of the steps while maintaining cleat intermesh, the step of this invention is formed with each cleat and intermittent groove on the riser having a curve which varies in radius elevation from the step tread to the lower edge of the riser. In other words, each riser cleat will follow a curve in elevation which curve is not defined by one radius from the tread to the bottom of the riser, but rather is defined by a plurality of radii from the tread to the bottom of the riser. In general, the radius in elevation of each riser cleat decreases as the cleat descends on the riser. Also, the decrease in cleat radii is more pronounced the farther radially outwardly in plan the cleats are located on the step riser.

It is therefore an object of this invention to provide an escalator step for use in a curved escalator which follows a path of travel defined in plan by a constant radius emanating from a fixed center.

It is a further object of this invention to provide an escalator step of the character described which has intermeshing tread and riser cleats on adjacent steps.

It is another object of this invention to provide an escalator step of the character described which can be horizontally pivoted in the escalator transition zones without binding the intermeshing cleats on adjacent steps.

These and other objects and advantages of the invention will become more readily apparent from the following detailed description of a preferred embodiment thereof when taken in conjunction with the accompanying drawings, in which:

BEST MODE FOR CARRYING OUT THE INVENTION

Figure 1:
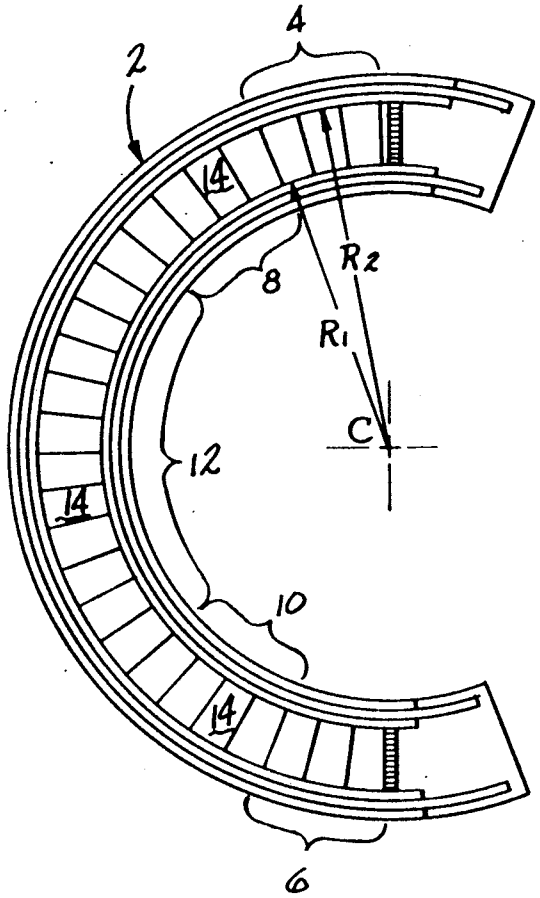
FIG. 1 is a plan view of a constant radius, fixed center curved escalator in which the step of this invention can be used.

Referring now to the drawings, there is shown in FIG. 1, in plan, a curved escalator 2 following a constant radius path of travel. The inner step chain follows a path of travel defined by radius $R_1$ struck from center point C, and the outer step chain follows a path of travel defined by radius $R_2$ struck from center point C. The escalator has several distinct travel zones, which are: entry and exit zones 4 and 6, respectively; entry and exit transition zones 8 and 10, respectively; and an inclined zone 12. In elevation, the steps 14 move horizontally in the entry and exit, or landing zones 4 and 6; and move along a varying slope angle path of travel in the transition zones 8 and 10; and along a constant slope angle path of travel in the inclined zone 12.

Figure 2:
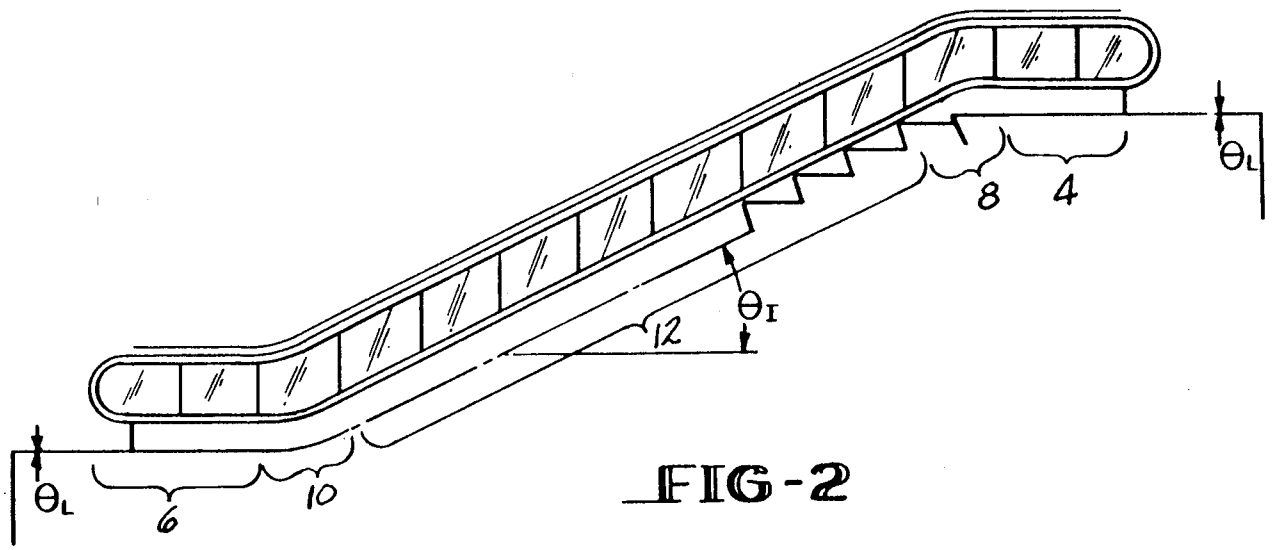
FIG. 2 is a side elevational planar projection of the escalator of FIG. 1.

It will be noted from FIG. 2 that the maximum slope angle of the inner step chain in the inclined zone 12 is $\theta_I$ and that the slope angle $\theta_L$ in the landing zones 4 and 6 is zero. Thus the slope angles in the transition zones 8 and 10 vary between zero and $\theta_I$. The location of the escalator 2 will determine and fix certain of the geometrical parameters, such as $R_1$, $R_2$, and $\theta_I$, which will be governed by the space available for the escalator, its sweep angle, and the height from landing to landing.

Figure 3:
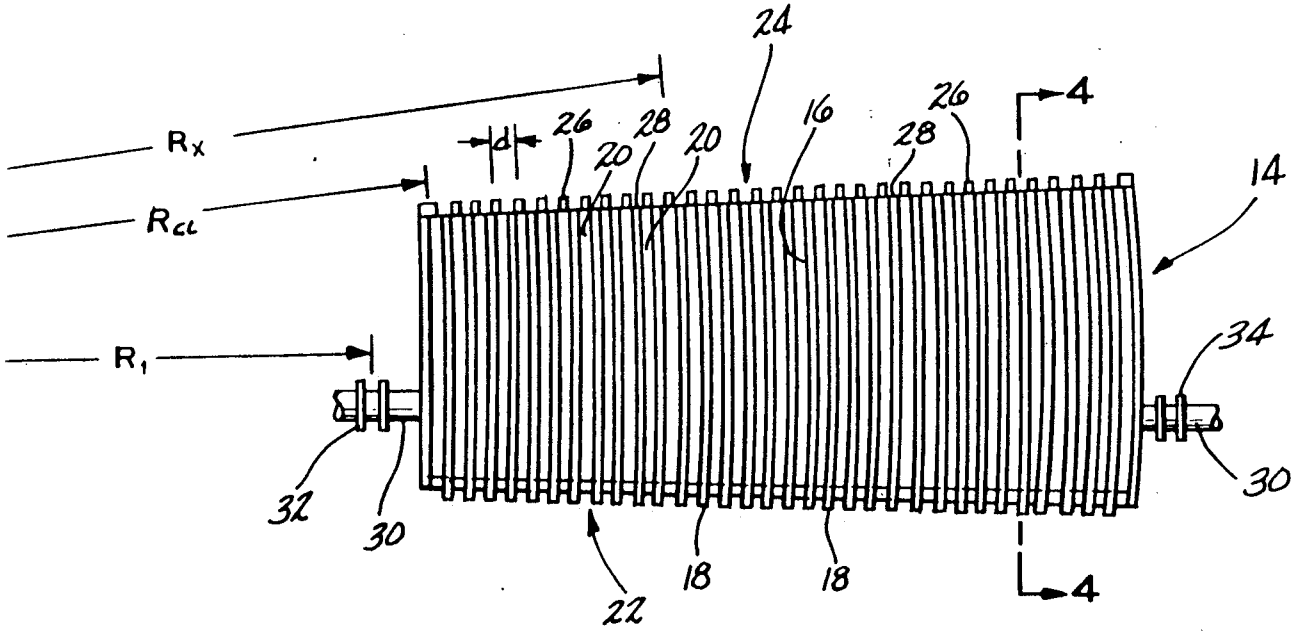
FIG. 3 is a plan view of an escalator step formed in accordance with this invention.

Referring to FIG. 3, a step 14 is shown in top plan view. The step 14 has a tread 16 which has a plurality of curvilinear tread cleats 18 with intervening tread grooves 20. The tread cleats 18 project beyond the edge 22 of the step 14 opposite the step riser 24. The riser 24 is formed with riser cleats 26 separated by intervening riser grooves 28. It will be noted that the tread cleats 18 are aligned with the riser grooves 28. The step 14 has a step axle 30 to which the inner step chain 32 and outer step chain 34 are connected. The radial distance between the center point C and the midplane of the innermost riser cleat is $R_{cl}$, and the distance between the midplanes of adjacent riser cleats 26 is d. Thus the plan radius $R_x$ of any riser cleat is $(R_{cl}+xd)$ where x is the number of the cleats in question counted from the innermost riser cleat.

Figure 4:
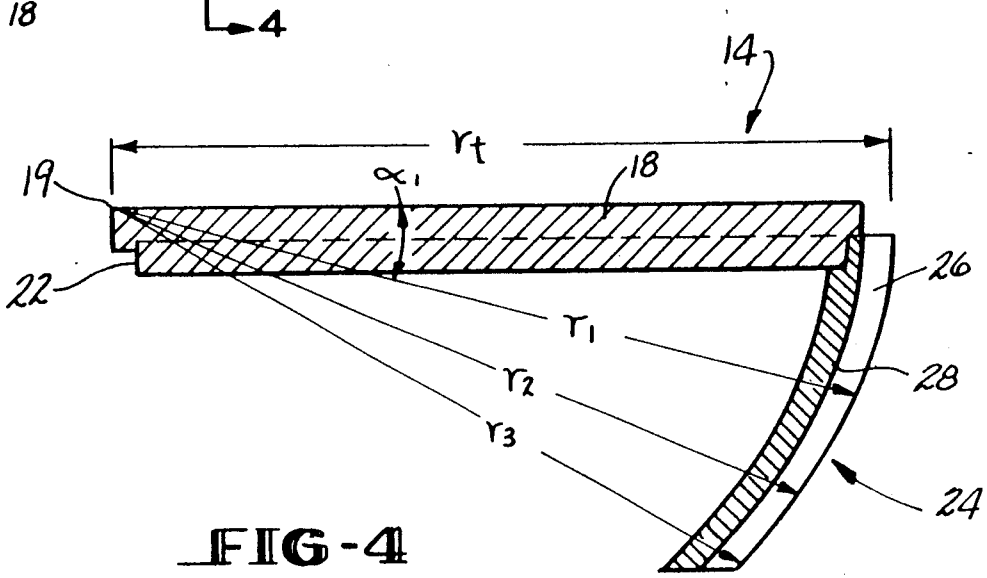
FIG. 4 is a sectional view of the step taken along line 4—4 of FIG. 3.

Referring to FIG. 4, the step 14 is shown in section taken along line 4—4 of FIG. 3. The configuration of the riser panel 24 is determined by a plurality of radii emanating from the upper corner 19 of each tread cleat 18. The radius $r_t$ is the distance between the tread cleat corner 19 and the projection plane of the uppermost edge of the riser cleat 26 which is inwardly or outwardly adjacent to the tread cleat 18. The radii $r_1$, $r_2$, $r_3$ and the like, which further define the curve of the riser cleat 26 are progressively smaller as they recede from the top surface of the tread cleat 18. Thus the length of each riser radius $r_x$ will be governed by the included angle $\alpha_x$ between the radius $r_x$ and the plane of the top surface of the tread cleat 18. The larger the angle $\alpha_x$ the smaller the radius $r_x$. Any particular riser cleat radius angle $\alpha_x$ and its corresponding riser cleat radius $r_x$ can be calculated by solving the following equations:

$$\alpha_X = \arctan\left[\frac{R_1}{(R_{cl} + xd)}(\tan\ \theta_\Delta)\right];$$

where $R_1$ is the plan radius of the inner step chain; and $(R_{cl}+xd)$ is the plan radius of the midplane of the riser cleat being plotted; and $\theta_\Delta$ is an incremental slope angle of the inner step chain in the transition zone of the escalator; and $$r_x = \frac{r_t \operatorname{Cos} \theta_I}{\operatorname{Cos} \alpha_x};$$

where $r_t$ is the elevation radius of the riser in the tread plane, and $\alpha_x$ is the elevation angle of the radius $r_x$ being calculated. $\theta_\Delta$ is a series of angles which are greater than $\theta_L$ and less than $\theta_I$. We prefer to divide the transition zone into ten equal increments and use ten incremental $\theta_\Delta$ angles to calculate ten different $r_x$ values. This procedure is as adequate as using one hundred or even one thousand equal increments for the purpose of practicing this invention.

Thus once the inner step chain plan radius; the incline zone slope angle; the number of cleats on the riser panel;

and the distance between the midplane of adjacent riser panel cleats are known, the riser can be properly profiled. The riser grooves simple follow the curve of the riser cleat either inwardly or outwardly adjacent to the groove in question.

It will be readily appreciated that the escalator step of this invention will have a cleated riser panel which is specifically configured to enable meshing interengagement with a cleated tread edge on an adjacent step on a curved escalator whose steps follow a path of travel in plan which is defined by a constant radius and a fixed center. Once the incline zone slope angle, the plan radius of the inner step chain, and the number of and distance between adjacent riser cleats are determined, the riser can be configured so as to provide a closely interfitting, non-jamming mesh between adjacent steps.

Since many changes and variations of the disclosed embodiment of the invention may be made without departing from the inventive concept, it is not intended to limit the invention otherwise than as required by the appended claims.

What is claimed is:

1. An escalator step for use in an escalator having a path of travel in plan which is defined by a fixed radius struck from a constant center, said step comprising:

a. a tread; and b. a riser connected to said tread, said riser being defined by curves in side elevation which have a maximum radius at the point of intersection of said riser with said tread and a minimum radius at the point on said riser most distal from said tread.

2. The escalator step of claim 1 wherein said riser curves are defined by a series of incremental radii which diminish from said maximum radius to said minimum radius.

3. The escalator step of claim 2 wherein said riser and tread include a plurality of cleats, with said incremental radii defining each riser cleat and being struck from a point defined in side elevation by the intersection of a top surface of an adjacent tread cleat with an end surface of said adjacent tread cleat, which end surface is distal of said riser.

4. The escalator step of claim 3 wherein the curve of each riser cleat is determined by solving the equations:

$$\alpha_X = \arctan\left[\frac{R_1}{(R_{c1} + xd)}(\tan\ \theta_\Delta)\right]; \text{ and}$$

$$r_x = \frac{r_t \operatorname{Cos} \theta_I}{\operatorname{Cos} \alpha_x};$$

wherein:

$\alpha_x$ is the included angle between a tread cleat and a point x on a next adjacent riser cleat in side elevation;

$R_1$ is the radius in plan of a radially inner step chain on the escalator;

$R_{cl}$ is the radius in plan of the radially innermost riser cleat on the step;

x is the number of the next adjacent riser cleat away from the innermost riser cleat;

d is the distance between the mid planes of adjacent riser cleats;

$\theta_\Delta$ is the slope angle in elevation at any given point in the escalator transition zone;

$r_x$ is the radius in side elevation at any point on the riser;

$r_t$ is the radius in side elevation on the riser in the tread plane;

$\theta_I$ I is the slope angle in elevation of the escalator in its inclined zone; and $\alpha_x$ is the side elevation angle between the tread plane and the radius $r_x$.

5. An escalator step for use in an escalator having a path of travel in plan which is defined by a fixed radius struck from a constant center, said step comprising:

a. tread having a plurality of tread cleats;

b. a riser connected to said tread, said riser having a plurality of riser cleats disposed between said tread cleats and adapted to mesh with the tread cleats on an adjacent step, said riser cleats each being defined in side elevation by a compound curve having a plurality of radii struck from an edge of said tread cleats most distal from said riser cleats, said radii being determined by solving the equations:

$$\alpha_X = \arctan\left[\frac{R_1}{(R_{c1} + xd)}(\tan\ \theta_\Delta)\right]; \text{ and}$$

$$r_x = \frac{r_t \operatorname{Cos} \theta_I}{\operatorname{Cos} \alpha_x};$$

wherein:

$\alpha_x$ is the included angle between a tread cleat and a point x on a next adjacent riser cleat in side elevation;

$R_l$ is the radius in plan of a radially inner step chain on the escalator;

$R_{cl}$ is the radius in plan of the radially innermost riser cleat on the step;

x is the number of the next adjacent riser cleat away from the innermost riser cleat;

d is the distance between the mid planes of adjacent riser cleats;

$\theta_\Delta$ is the slope angle in elevation at any given point in the escalator transition zone;

$r_x$ is the radius in side elevation at any point on the riser;

$r_t$ is the radius in side elevation on the riser in the tread plane;

$\theta_I$ is the slope angle in elevation of the escalator in its inclined zone; and $\alpha_x$ is the side elevation angle between the tread plane and the radius $r_x$.

* * * * *